US006422038B1

(12) United States Patent
Chin

(10) Patent No.: US 6,422,038 B1
(45) Date of Patent: Jul. 23, 2002

(54) SINGLE PRONG JEWERLY SETTING

(76) Inventor: Edmond Chin, 108 Emerald Hill Road, Singapore (SG)

( * ) Notice: Subject to any disclaimer, the term of this patent is extended or adjusted under 35 U.S.C. 154(b) by 0 days.

(21) Appl. No.: 09/558,188

(22) Filed: Apr. 26, 2000

(51) Int. Cl.[7] ..... A44C 17/02

(52) U.S. Cl. ..... 63/26; 63/27; D11/91; D11/92

(58) Field of Search ..... 63/26, 27; D11/91, D11/92

(56) References Cited

U.S. PATENT DOCUMENTS

| | | | | | |
|---|---|---|---|---|---|
| 1,211,240 | A | * | 1/1917 | Ryan | 63/26 |
| 4,781,038 | A | * | 11/1988 | Branca et al. | 63/26 |
| 5,339,655 | A | * | 8/1994 | Grando | 63/9 |
| 6,023,947 | A | * | 2/2000 | Afuku et al. | 63/26 |
| 6,112,551 | A | * | 9/2000 | Noda | 63/26 |
| D436,885 | S | * | 1/2001 | Manfredi | D11/91 |

FOREIGN PATENT DOCUMENTS

| | | | | |
|---|---|---|---|---|
| FR | 451013 | * | 1/1913 | 63/26 |
| GB | 463129 | * | 6/1935 | 63/26 |
| GB | 2026303 | * | 2/1980 | 63/26 |

* cited by examiner

*Primary Examiner*—Jack Lavinder
*Assistant Examiner*—Andrea Chop
(74) *Attorney, Agent, or Firm*—Cooper & Dunham LLP

(57) ABSTRACT

A jewelry setting for a stone having an arm, a single crown prong at the top of the arm, a pavilion prong at the bottom of the arm, and a girdle box attached to the arm between the crown prong and the pavilion prong. The girdle box has a number of bearings extending inwardly therefrom. When a stone having a crown and a pavilion is set, the crown is held by the crown prong, the culet is held by the pavilion prong, and the girdle is held by the girdle box.

10 Claims, 8 Drawing Sheets

SINGLE PRONG JEWERLY SETTING

FIELD OF THE INVENTION

The present invention relates to a jewelry setting in which only one prong of the setting touches the crown of a cut gem stone having a crown and a pavilion.

BACKGROUND OF THE INVENTION

There are known many different ways to set a gem stone so that the stone is secured and may be worn as jewelry. For example, a bezel setting utilizes a rim made of precious metal or other material that completely encircles the crown of the stone to hold the stone in place. A channel setting secures a row of stones through two parallel rims, each of which touches the crown of each stone.

Another common type of setting utilizes prongs of precious metal or other material to secure the stone. Prong settings usually have four or six prongs, each of which grips the crown of the stone and is visible when looking directly at the crown. A setting with fewer prongs will hold a stone less securely than one with more prongs. Settings with only two prongs exist, but are generally regarded as unsafe and are usually used only for smaller stones.

When a prong setting is used to secure a stone having a crown and a pavilion, it is desirable to minimize the number of prongs that grip the stone's crown, so that the prongs detract from the appearance of the stone as little as possible. There previously has not been known a prong setting for securing a stone having a crown and a pavilion in which only one prong grips the stone's crown and that single prong is all that is visible when viewing the stone directly.

SUMMARY OF THE INVENTION

It is an object of the present invention to provide a jewelry setting for a gem stone that has a crown and a pavilion whereby only a single prong grips the crown of the stone.

It is another object of the present invention to provide a jewelry setting whereby only a single prong is visible when the stone is viewed directly.

It is yet another object of the present invention to provide a jewelry setting that has only one prong that grips the crown of a stone but does not protrude onto the table of the stone.

It is still another object of the present invention to provide a jewelry setting that will securely hold a stone while minimally interfering with the appearance of the stone when viewed from above or from the side.

The present invention contemplates a jewelry setting that has an arm from which extend three distinct components, each of which serve to secure a stone that is set in the setting. A crown prong extends from the top of the arm to securely grip the crown of the stone. A pavilion prong extends from the bottom of the arm to securely grip the culet of the stone. A girdle box extends from the arm at a point between the crown prong and the pavilion prong and encircles the pavilion of the stone at a point below the girdle of the stone. The girdle box may have a number of bearings on its interior face to prevent the set stone from slipping in the setting.

DETAILED DESCRIPTION OF THE INVENTION

Figure 1:
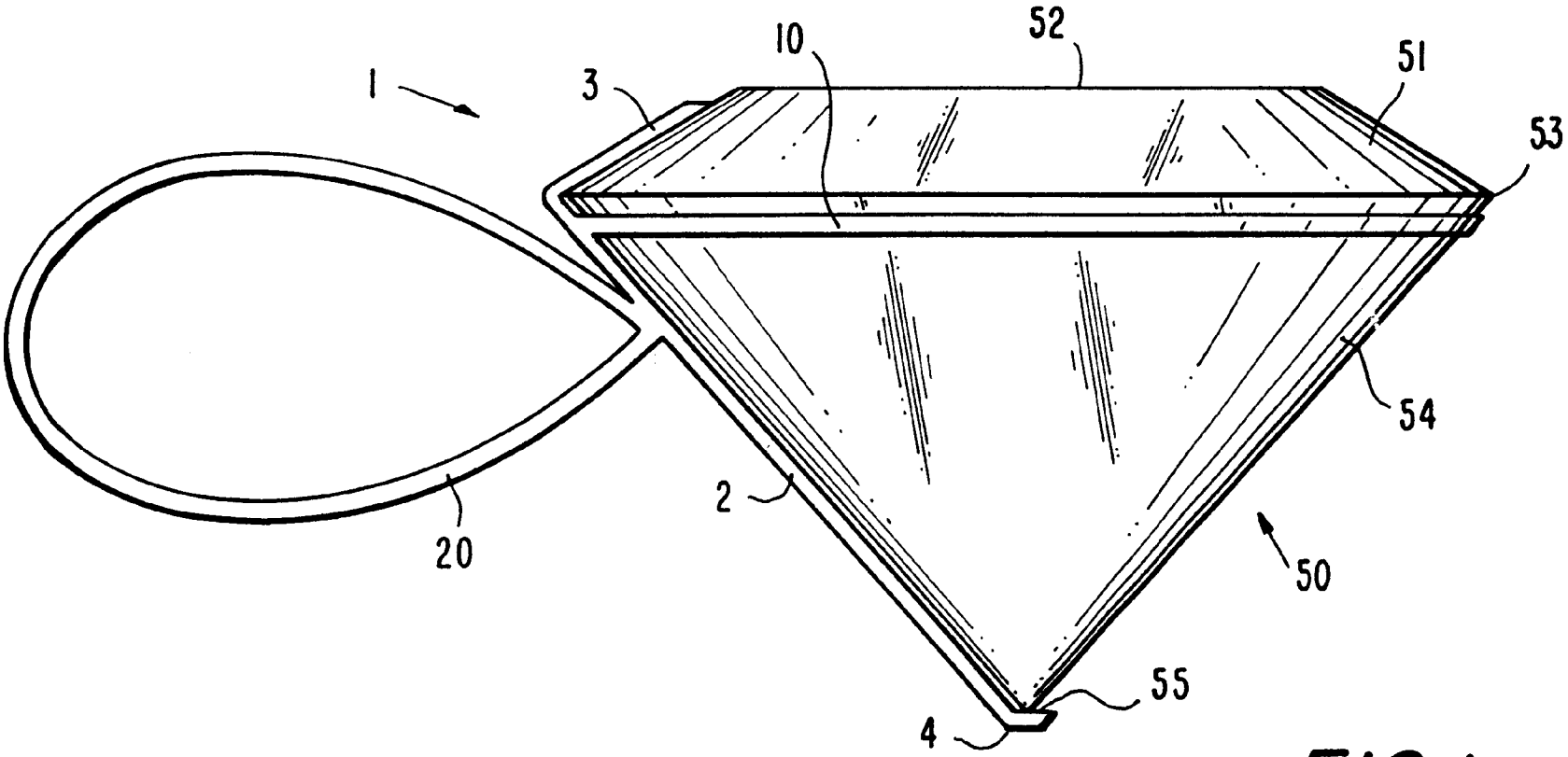
FIG. 1 is a side view of a first embodiment of the present invention, also containing an attachment loop, with a Stone set therein.
Figure 2:
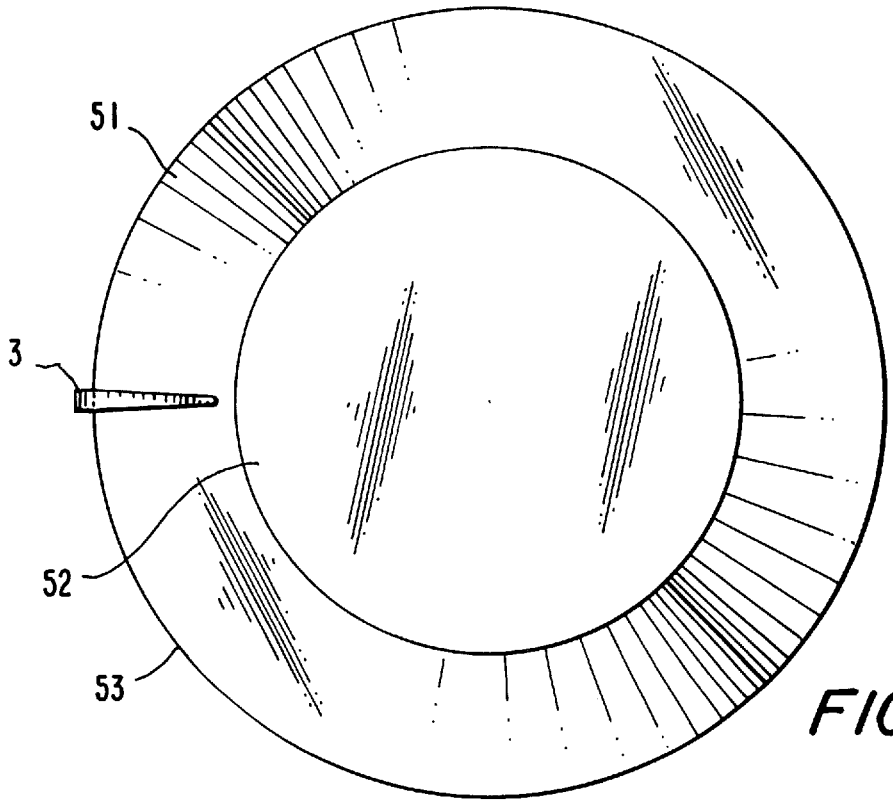
FIG. 2 is a top view of a first embodiment of the present invention with a stone set therein.

Generally, as shown in FIGS. 1–12 of the drawings, the present invention relates to a jewelry setting in which only one prong of the setting touches the crown of a gem stone set therein.

FIGS. 1–6 show a first preferred embodiment of the jewelry setting of the present invention. Referring to FIGS. 1–5, setting 1 comprises an arm 2, a crown prong 3, a pavilion prong 4, and a girdle box 10. Setting 1 may be made of a precious metal, such as gold, silver or platinum, another metal or metal alloy, or another material, such as plastic. A stone 50 is held within setting 1. The stone 50 may be a diamond or other cut gem stone.

Crown prong 3 is permanently fixed to the top end of arm 2 and extends at an angle from the top end of arm 2. When stone 50 is set in setting 1, arm 2 runs along the length of the pavilion 54 of stone 50, and crown prong 3 contacts the crown 51 of stone 50 from about the girdle 53 of stone 50 to a point on crown 51 below table 52. It is not necessary for crown prong 3 to extend completely to and make contact with table 52 of stone 50, although such contact may be made.

Figure 3:
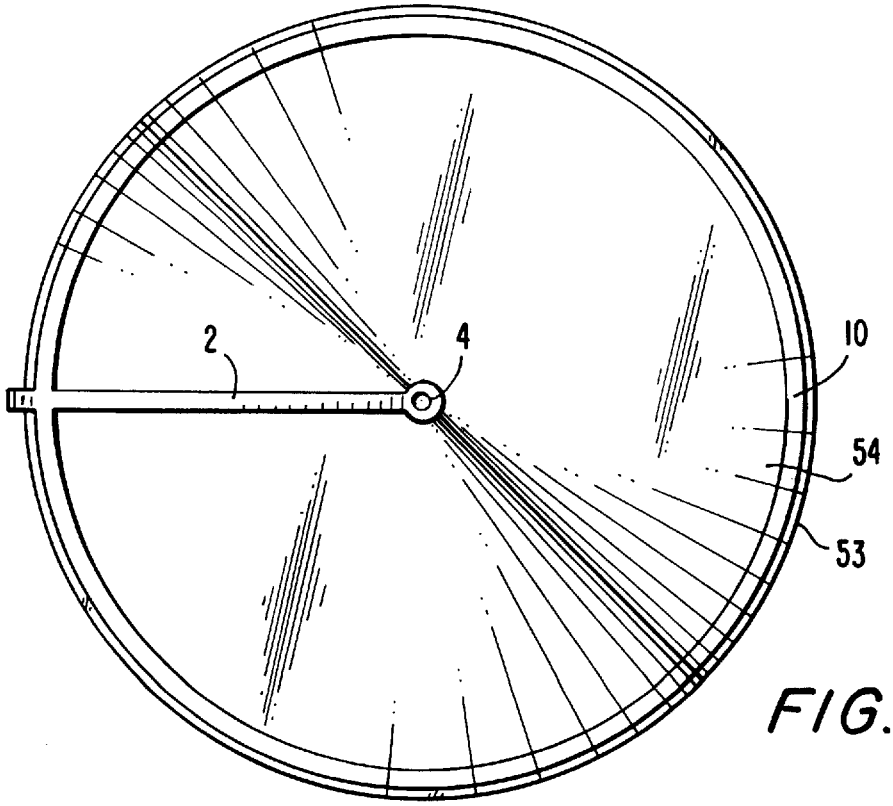
FIG. 3 is a bottom view of a first embodiment of the present invention with a stone set therein.
Figure 4:
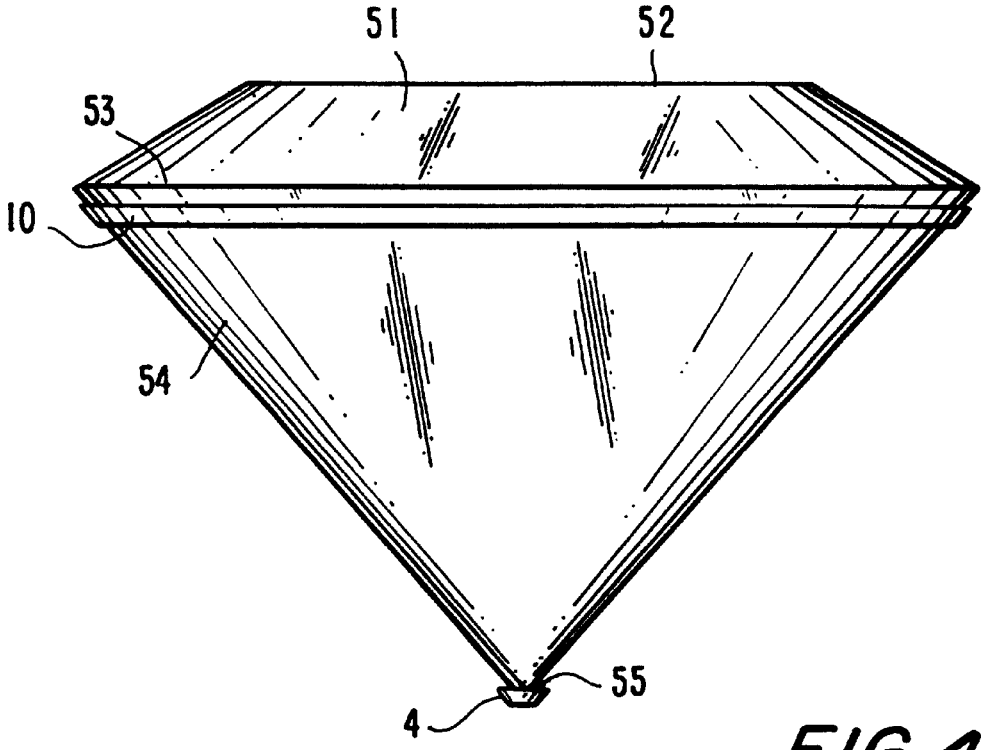
FIG. 4 is a front view of a first embodiment of the present invention with a stone set therein.
Figure 5:
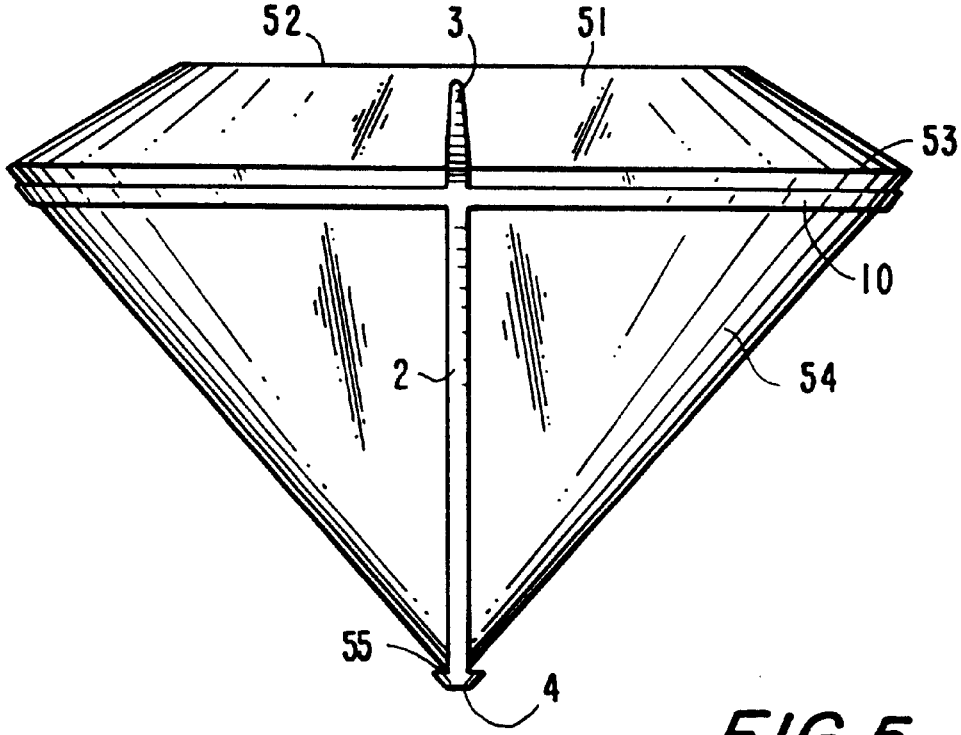
FIG. 5 is a back view of a first embodiment of the present invention with a stone set therein.

Pavilion prong 4 is fixed to the bottom end of arm 2 and extends at an angle from the bottom end of arm 2. When stone 50 is set in setting 1, and arm 2 runs along the length of the pavilion 54 of stone 50, pavilion prong 4 is substantially perpendicular to the length of stone 50 as measured from its culet 55 to a point in the center of its table 52. Pavilion prong 4 may be circular in horizontal cross-section, as shown in FIG. 3, or may be another shape in horizontal cross-section. The horizontal cross-sectional area of pavilion prong 4 must be greater than the surface area of culet 55 of stone 50 set in setting 1.

Girdle box 10 is a ring fixed to a point on arm 2 between crown prong 3 and pavilion prong 4 and extending at an angle from that point of arm 2 in the same direction as and substantially parallel to pavilion prong 4. The point on arm 2 to which girdle box 10 is fixed is such that when stone 50 is set in setting 1, girdle box 10 encircles stone 50 below its girdle 53.

Figure 6:
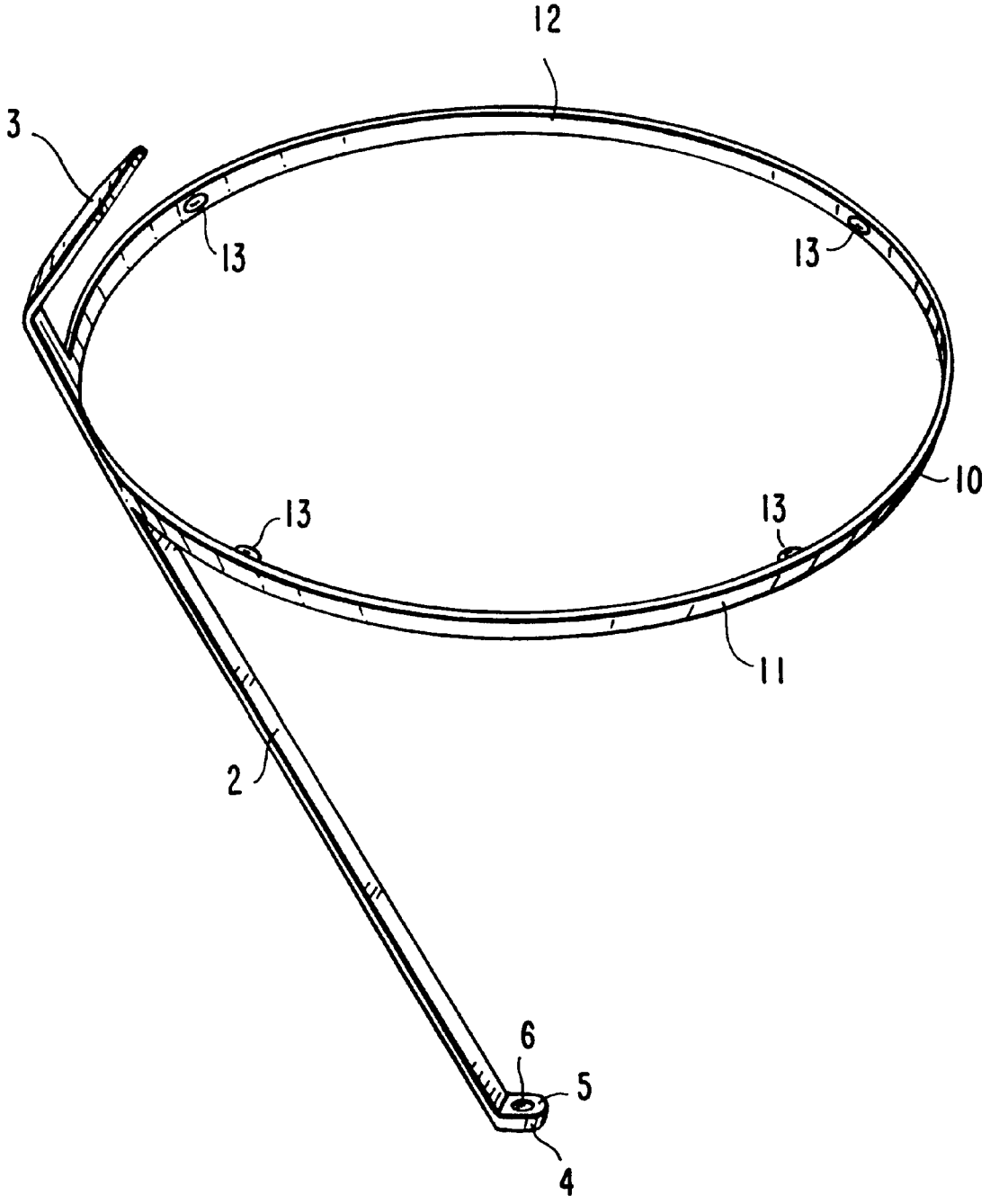
FIG. 6 is a perspective view of a first embodiment of the present invention.
Figure 7:
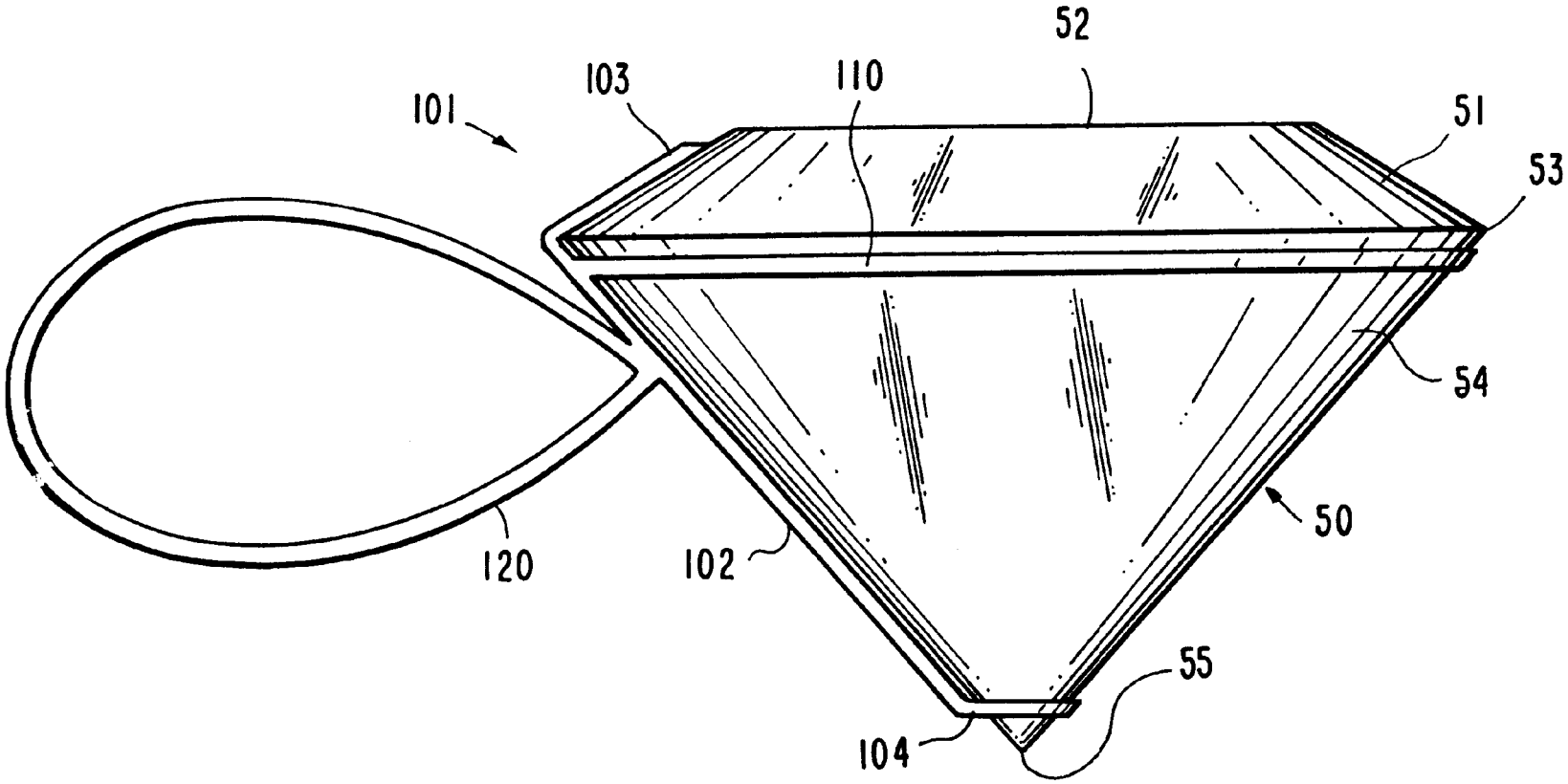
FIG. 7 is a side view of a second embodiment of the present invention, also containing an attachment loop, with a stone set therein.
Figure 8:
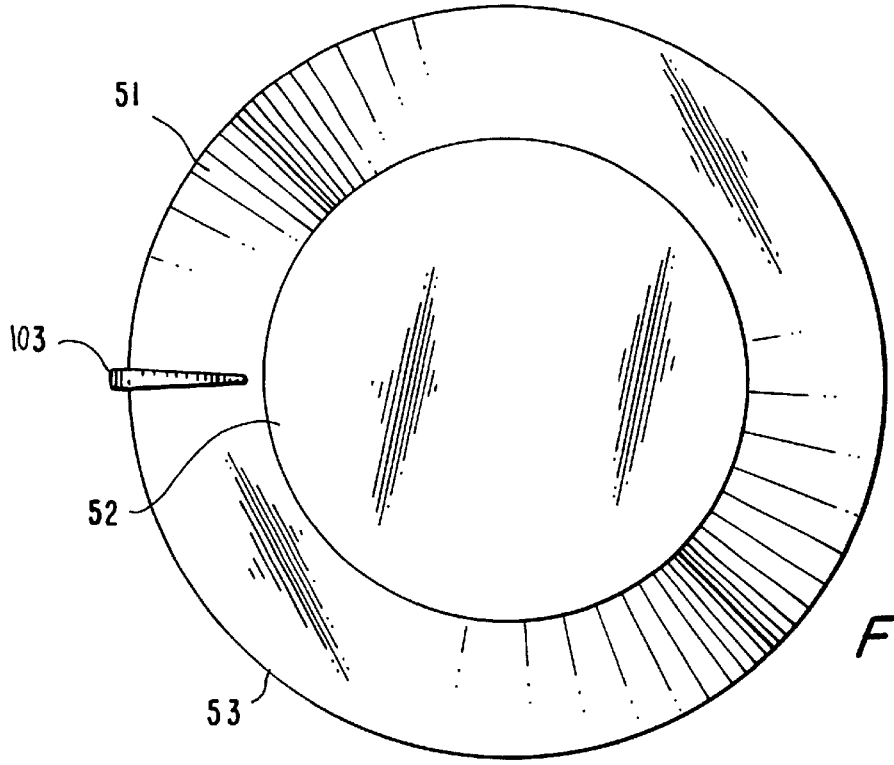
FIG. 8 is a top view of a second embodiment of the present invention with a stone set therein.
Figure 9:
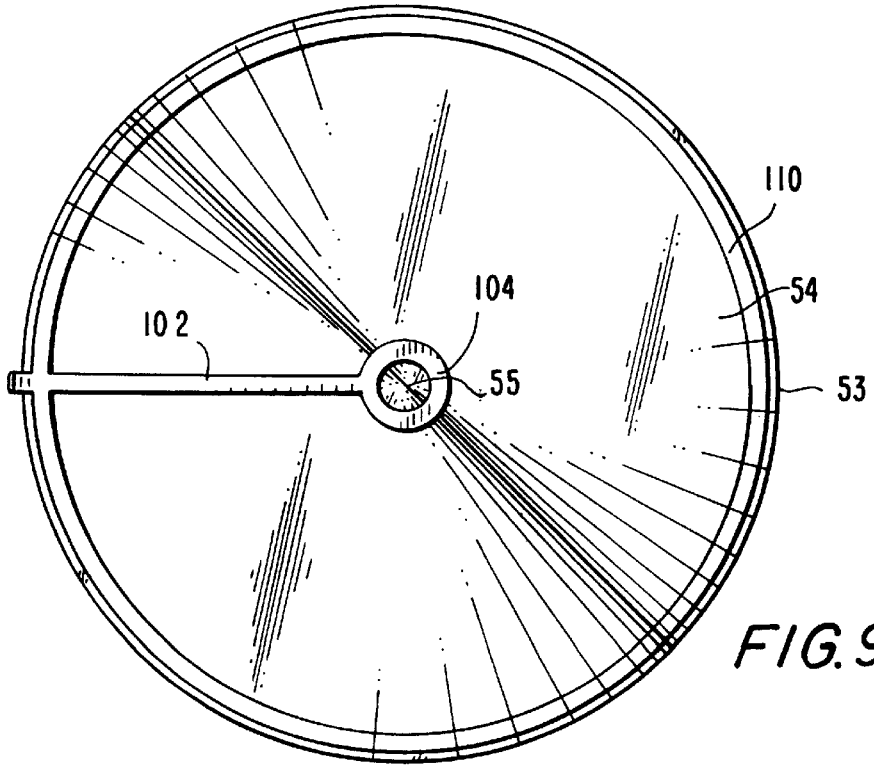
FIG. 9 is a bottom view of a second embodiment of the present invention with a stone set therein.
Figure 10:
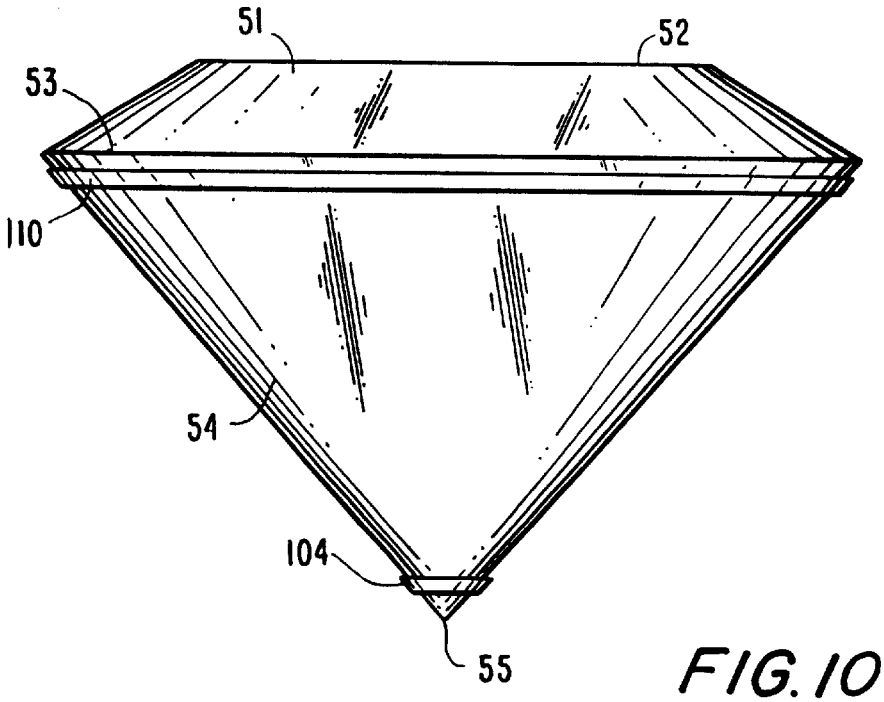
FIG. 10 is a front view of a second embodiment of the present invention with a stone set therein.
Figure 11:
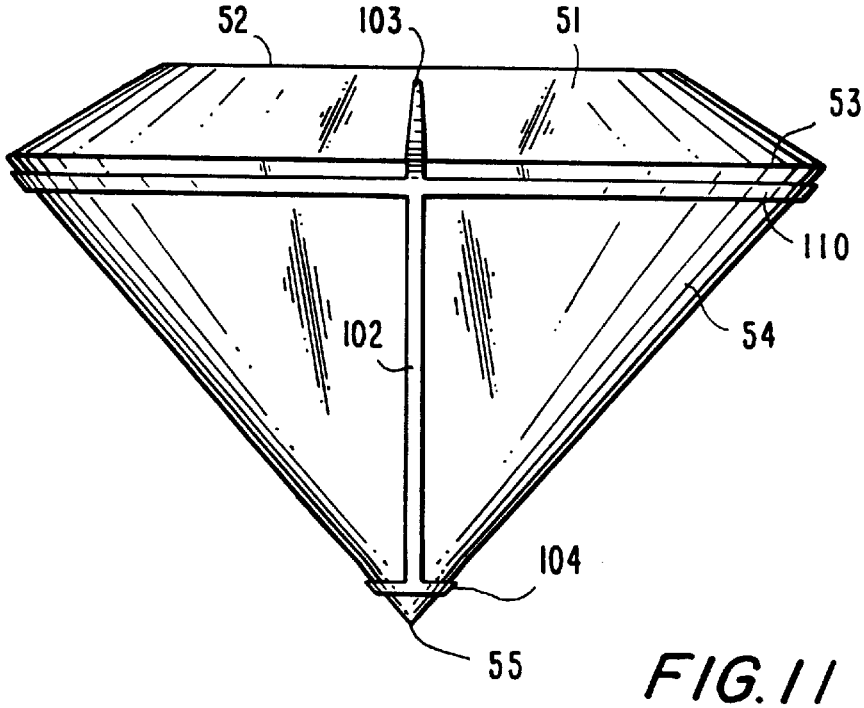
FIG. 11 is a back view of a second embodiment of the present invention with a stone set therein.

Referring now to FIG. 6, girdle box 10 has an exterior face 11 and an interior face 12. The circumference of interior face 12 of girdle box 10 is slightly larger than the circumference of the pavilion 54 of a stone 50 set in setting 1 at the point at which girdle box 10 encircles the stone 50. Attached at multiple points around the interior face 12 of girdle box 10 are a plurality of bearings 13. Bearings 13 extend inwardly from interior face 12 so that each bearing 13 contacts the pavilion 54 of stone 50 set in setting 1, thereby preventing stone 50 from moving with respect to girdle box 10 and setting 1.

Pavilion prong 4 has a top face 5 which is adapted to contact culet 55 of stone 50 set in setting 1. A dimple 6 is impressed into top face 5 of pavilion prong 4 substantially in the center thereof. The horizontal cross-sectional area of dimple 6 must be slightly larger than the surface area of culet 55 of stone 50 so that when stone 50 is set in setting 1, dimple 6 acts as a cup and culet 55 is securely held in place with respect to dimple 6 and pavilion prong 4. The depth of dimple 6 may be as small as 1 mm or less. Alternatively, it may be very deep with respect to pavilion prong 4 or run the entire vertical length of pavilion prong 4, so long as its horizontal cross-sectional area remains only slightly larger that the surface area of culet 55.

When a stone 50 is set in setting 1, crown prong 3 grips the crown 51 of stone 50 from about the girdle 53 of stone 50 to a point on crown 51 below table 52. The culet 55 of stone 50 is held firmly in place within dimple 6 of pavilion prong 4. Girdle box 10 encircles the pavilion 54 of stone 50 at a point below girdle 53, and bearings 13 contact pavilion 54 to prevent stone 50 from moving with respect to girdle box 10 and setting 1. Stone 50 is thus securely held within setting 1, and only single crown prong 3 is visible when stone 50 is viewed from above.

Referring again to FIG. 1, setting 1 may also have an attachment loop 20 fixed to arm 2. Attachment loop 20 extends from a point on arm 2 between crown prong 3 and pavilion prong 4 in a direction opposite that of girdle box 10 and substantially parallel thereto, and is oriented so that its perimeter is visible when setting 1 is viewed from the side. Attachment loop 20 may be pear-shaped, circular, or another shape and its size is such that a chain or link may pass therethrough.

FIGS. 7–12 show a second preferred embodiment of the jewelry setting of the present invention. Referring to FIGS. 7–11, setting 101 comprises an arm 102, a crown prong 103, a pavilion box 104, and a girdle box 110. Setting 101 may be made of a precious metal, such as gold, silver or platinum, another metal or metal alloy, or another material, such as plastic.

Crown prong 103 is permanently fixed to the top end of arm 102 and extends at an angle from the top end of arm 102. When stone 50 is set in setting 101, arm 102 runs along the length of the pavilion 54 from about girdle 53 to a point above culet 55 of stone 50, and crown prong 103 contacts the crown 51 of stone 50 from about girdle 53 of stone 50 to a point on crown 51 below table 52. It is not necessary for crown prong 103 to extend completely to and make contact with table 52 of stone 50, although such contact may be made.

Pavilion box 104 is a ring fixed to the bottom end of arm 102. Pavilion box 104 extends at an angle from the bottom end of arm 102 so that when a stone 50 is set in setting 101, arm 102 runs along the length of the pavilion 54 from girdle 53 to a point above culet 55 of stone 50, and pavilion box 104 is substantially perpendicular to the length of stone 50 as measured from its culet 55 to a point in the center of its table 52, and encircles pavilion 54 at a point above culet 55. The inner circumference of pavilion box 104 must be substantially equivalent to the outer circumference of pavilion 54 of stone 50 set in setting 101 at the point at which pavilion box 104 encircles pavilion 54. Pavilion box 104 acts as a cup to securely hold culet 55 in place.

Girdle box 110 is a ring fixed to a point on arm 102 between crown prong 103 and pavilion box 104 extending at an angle from that point of arm 102 in the same direction as and substantially parallel to pavilion box 104. The point on arm 102 to which girdle box 110 is fixed is such that when stone 50 is set in setting 101, girdle box 110 encircles stone 50 below its girdle 53.

Figure 12:
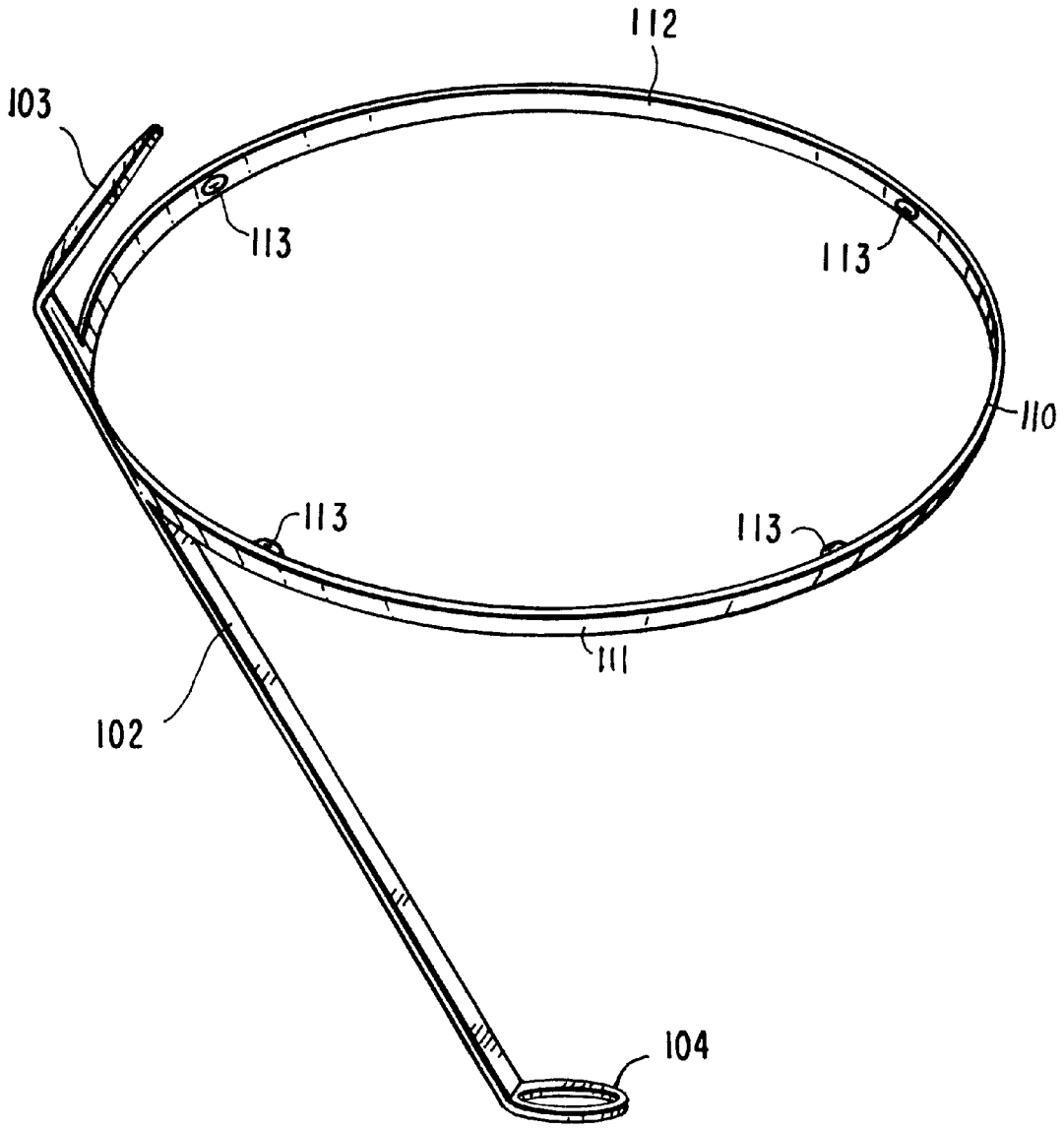
FIG. 12 is a perspective view of a second embodiment of the present invention.

Referring now to FIG. 12, girdle box 110 is a ring having an exterior face 111 and an interior face 112. The circumference of interior face 112 of girdle box 110 is slightly larger than the circumference of the pavilion 54 of stone 50 set in setting 101 at the point at which girdle box 110 encircles the stone 50. Fixed to multiple points around the interior face 112 of girdle box 110 are a plurality of bearings 113. Bearings 113 extend inwardly from interior face 112 so that each bearing 113 contacts the pavilion 54 of stone 50 set in setting 101, thereby preventing stone 50 from moving with respect to girdle box 110 and setting 101.

When a stone 50 is set in getting 101, crown prong 103 grips the crown 51 of stone 50 from a point on the girdle 53 of stone 50 to a point on crown 51 below table 52. The culet 55 of stone 50 extends through pavilion box 104 so that pavilion box 104 firmly holds pavilion 54 in place at a point above culet 55. Girdle box 110 encircles the pavilion 54 of stone 50 at a point below girdle 53, and bearings 113 contact pavilion 54 to prevent stone 50 from moving with respect to girdle box 110 and setting 101. Stone 50 is thus securely held within setting 101, and only single crown prong 103 is visible when stone 50 is viewed from above.

Referring again to FIG. 7, setting 101 may also have an attachment loop 120 fixed to arm 102. Attachment loop 120 extends from a point on arm 102 between crown prong 103 and pavilion box 104 in a direction opposite that of girdle box 110 and substantially parallel thereto, and is oriented so that its perimeter is visible when setting 101 is viewed from the side. Attachment loop 120 may be pear-shaped, circular, or another shape and its size is such that a chain or link may pass therethrough.

Having described the present invention with particular reference to the disclosed preferred embodiments, it will be apparent to those skilled in this art that various changes and modifications may be made therein without departing from the scope and spirit of the invention, which is disclosed and claimed herein,

What is claimed is:

1. A jewelry setting for a stone having a crown and a pavilion, comprising an arm, only a single crown prong, said single crown prong being located at a first end of said arm, and a girdle box at said arm at a point between said single crown prong and said pavilion prong, so that when the stone is set in said setting, said single crown prong is adapted to grip the crown of the stone, said pavilion prong is adapted to grip a culet of the stone, and said girdle box is adapted to encircle the pavilion of the stone at a point below a girdle of the stone.

2. The jewelry setting according to claim 1, wherein said pavilion prong comprises a cup which is adapted to hold the culet of the stone.

3. The jewelry setting according to claim 2, wherein said cup is a dimple set in a first face of said pavilion prong.

4. The jewelry setting according to claim 1, wherein said girdle box is a ring having a plurality of bearings on an interior face thereof, each of said bearings being adapted for contacting the pavilion of the stone.

5. The jewelry setting according to claim 1, further comprising an attachment loop on said arm extending from said arm in a direction opposite that of said girdle box.

6. A jewelry setting for a stone having a crown and a pavilion, comprising an arm, only a single crown prong, said single crown prong being located at a first end of said arm, a pavilion box at a second end of said arm, and a girdle box at said arm at a point between said single crown prong and said pavilion box, so that when the stone is set in said setting, said single crown prong is adapted to grip the crown of the stone, said pavilion box is adapted to encircle the pavilion of the stone at a point above a culet of the stone, and said girdle box is adapted to encircle the pavilion of the stone at a point below a girdle of the stone.

7. The jewelry setting according to claim 6, wherein said pavilion box is a cup into which the culet of the stone is adapted to be placed.

8. The jewelry setting according to claim 6, wherein said pavilion box is a ring through which the culet of the stone is adapted to be placed.

9. The jewelry setting according to claim 6, wherein said girdle box is a ring having a plurality of bearings on an interior face thereof, each of said bearings being adapted for contacting the pavilion of the stone.

10. The jewelry setting according to claim 6, further comprising an attachment loop on said arm extending from said arm in a direction opposite that of said girdle box.

* * * * *